US008507702B2

(12) United States Patent
Feng et al.

(10) Patent No.: US 8,507,702 B2
(45) Date of Patent: Aug. 13, 2013

(54) CONTINUOUS PRODUCTION OF BIODERIVED ESTERS VIA SUPERCRITICAL SOLVENT PROCESSING USING SOLID HETEROGENEOUS CATALYSTS

(75) Inventors: Maoqi Feng, San Antonio, TX (US); Chee-Kai Tan, San Antonio, TX (US)

(73) Assignee: Southwest Research Institute, San Antonio, TX (US)

( * ) Notice: Subject to any disclaimer, the term of this patent is extended or adjusted under 35 U.S.C. 154(b) by 387 days.

(21) Appl. No.: 13/074,205

(22) Filed: Mar. 29, 2011

(65) Prior Publication Data

US 2012/0253057 A1 Oct. 4, 2012

(51) Int. Cl.
*C11C 1/00* (2006.01)

(52) U.S. Cl.
USPC ..... 554/167

(58) Field of Classification Search
USPC ..... 554/167
See application file for complete search history.

(56) References Cited

U.S. PATENT DOCUMENTS

| | | | |
|---|---|---|---|
| 4,115,424 | A | 9/1978 | Unland et al. |
| 4,859,696 | A | 8/1989 | Kamiya et al. |
| 5,308,365 | A | 5/1994 | Kesling, Jr. et al. |
| 7,671,124 | B2 | 3/2010 | Tsujimoto et al. |
| 2007/0238905 | A1 | 10/2007 | Arredondo et al. |
| 2010/0121087 | A1 | 5/2010 | Banavali et al. |
| 2010/0125145 | A1 | 5/2010 | Yu et al. |
| 2010/0270239 | A1 | 10/2010 | Zhu et al. |
| 2011/0065943 | A1 | 3/2011 | Banavali et al. |
| 2012/0193580 | A1 | 8/2012 | Feng et al. |

OTHER PUBLICATIONS

Otera, "Transesterification," Chem. Rev. 93 (1993), pp. 1449-1970.
Davies, et al, "Continuous transesterification of ethyl alcohol and butyl acetate in a sieve plate column: II. Batch reaction kinetic studies," Trans. Inst. Chem. Eng. 51 (1973), pp. 271-274.
Freedman, et al., "Tranesterification kinetics of soybean oil," J. Am. Oil Chem. Soc. 63(1986), pp. 1375-1380.
Schmidt, et al, "Kinetics of ethanol and butyl acetate—a model system for reactive rectification," Chem. Ing. Tech.71 (1999), pp. 704-708.
Felizardo, et al., "Production of biodiesel from waste frying oils," Waste Management, vol. 26, Issue 5, 2006, pp. 487-494.
Phan, et al., "Biodiesel production from waste cooking oils," Fuel, vol. 87, Issues 17-18, 2008, pp. 3490-3496.
Gryglewicz, "Alkaline—earth metal compounds as alcoholysis catalysts for eater oils synthesis," Appl. Catal. A 192 (2000), pp. 23-28.
Darnoko et al., Kinetics of palm oil transesterification in a batch reactor, J. Am. Oil Chem. Soc. 77 (2000), pp. 1263-1267.
Guan, et al., "Tri-potassium phosphate as a solid catalyst for biodiesel production from waste cooking oil," Fuel Processing Technology, vol. 90, Issue 4 (2009), pp. 520-524.
Georgogianni, et al. "Transesterification of soybean frying oil to biodiesel using heterogeneous catalysts," Fuel Processing Technology, vol. 90 Issue 5 (2009), pp. 671-676.

(Continued)

*Primary Examiner* — Deborah D Carr
(74) *Attorney, Agent, or Firm* — Grossman, Tucker et al

(57) ABSTRACT

A method for the continuous production of ester based organic compounds from renewable natural products via supercritical solvent processing in the presence of heterogeneous nano-structured catalysts. Fatty acid triglycerides may therefore be transesterified using heterogeneous nano-structured catalysts in the presence of supercritical alcohols to provide alkyl ester compounds and glycerine.

23 Claims, 2 Drawing Sheets

(56) References Cited

OTHER PUBLICATIONS

Dossin, et al., "Kinetics of heterogeneously MgO-catalyzed transesterification," Appl. Catal. B Environ. 62 (2006), pp. 35-45.
Reddy, et al., "Room-Temperature Conversion of Soybean Oil and Poultry Fat to Biodiesel Catalyzed by Nanocrystalline Calcium Oxide," Energy & Fuels 20 (2006), pp. 1310-1314.
Demirbas, "Biodiesel fuels from vegetable oils via catalytic and non-catalytic supercritical alcohol transesterifications and other methods: a survey," 44 (2003), pp. 2093-2109.
Kusdiana, et al., "Effects of water on biodiesel fuel production by supercritical treatment," Bioresour. Technol. 91 (2004), pp. 289-295.
Han, et al., "Preparation of biodiesel from soybean oil using supercritical methanol and carbon dioxide as cosolvent," Process Biochem 40 (2005), pp. 3148-3151.
Bunyakiat, et al., "Continuous production of biodiesel via transesterfication from vegetable oils in supercritical methanol," Energy & Fuels 20 (2006), pp. 812-817.
Warabi, et al., "Reactivity of triglycerides and fatty acids of rapeseed oil in supercritical alcohols," Bioresource Technol. 91 (2004), pp. 283-287.
Komers, et al., "Biodiesel from rapeseed oil and KOH 2. Composition of solution of KOH in methanol as reaction partner of oil," Eur. J. Lipid Sci. Technol. 103 (2001), pp. 359-462.
Kusdiana, et al., "Kinetics of transesterification in rapeseed oil to biodiesel fuels as treated in supercritical methanol," Fuel 80 (2001), pp. 693-698.
Kusdiana, et al., "Methyl esterification of free fatty acids of rapeseed oil as treated in supercritical methanol," Chem. Eng. Jpn., vol. 34, No. 3 (2001), pp. 383-387.
Coa, et al., "Preparation of biodiesel from soybean oil using supercritical methanol and co-solvent," Fuel 84 (2005), pp. 347-351.
Rathore, et al., "Syntheis of biodiesel from edible and non-edible oils in supercritical alcohols and enzymatic synthesis in supercritical carbon dioxide," Fuel 86 (2007), pp. 2650-2659.
Patil, et al., "Conversion of waste cooking oil to biodiesel using ferric sulfate and supercritical methanol processes," Fuel 89 (2019), pp. 360-364.
Demirbas, "Biodiesel from sunflower oil in supercritical methanol with calcium oxide," Energy Conv. Manag. 48 (2007), pp. 937-941.
He, et al., "Continuous production of biodiesel fuel from vegetable oil using supercritical methanol process," Fuel 86 (2007), pp. 442-447.
Suppes, et al., "Transesterification of soybean oil with zeolite and metal catalysts," Appl. Catal., 257 (2004), pp. 213-223.
Helwani, et al., "Technologies for production of biodiesel focusing on green catalytic techniques: A review," Fuel Processing Technology 90 (2009), pp. 1502-1514.
Ding, et al, "Modification of the Ultrastable Y Zeolite with Citric Acid in the Unbuffered System," J. Mol. Catal. vol. 11, No. 3 (1997) 163-164.
Xin-Mei, et al., "Optimization of nanopores and acidity of USY zeolite by citric modification," Catalysis Today 68 (2001) 145-154.
Noureddini, et al, "Production of Ethers of Glycerol From Crude Glycerol—The By-Product of Biodiesel Production"; University of Nebraska-Lincoln, Digital Commons@University of Nebraska-Lincoln, Papers in Biomaterials, Chemical and Biomolecular Engineering Research and Publications, Jan. 1, 1998, Paper 18, http://digitalcommons.unl.edu/chemeng_biomaterial/18.
Marulanda, et al; "Biodiesel Fuels Through a Continuous Flow Process of Chicken Fat Supercritical Transesterification"; Energy Fuels 2010, 24, 253-260; energy&fuels article; 2009 American Chemical Society.
Chaudhari, et al Production of Hydrogen and/or Syngas (H2 + CO) via Steam Gasification of Biomass-Derived Chars; Energy & Fuels 2003, 17, 1062-1067; 2003 American Chemical Society.
Hoang, et al, "Conversion of Glycerol to Alkyl-aromatics Over Zeolites"; 2010 American Chemical Society, Energy Fuels 2010, 24, 3804-3809.
Pathak, et al "Catalytic Conversion of Glycerol to Value Added Liquid Products"; Applied Catalysis A; General 372 (2010) 224-238.
Barrault, et al Selective Oligomerization of Glycerol Over Mesoporous Catalysts; Topics in Catalysis, vol. 27, Nos. 1-4, Feb. 2004, 137-142, 2004 Plenum Publishing Corporation.
Silva, et al "Glycerol Acetals As Anti-Freezing Additives for Biodiesel"; Bioresource Technoloty 101 (2010) 6225-6229, Science Direct.
Garcia, et al "New Class of Acetal Derived From Glycerin As a Biodiesel Fuel Component" 2008 American Chemical Society, Energy & Fuels 2008, 22, 4274-4280.
Mallon, et al "Driving Forces for Adsorption of Polyols Onto Zeolites From Aqueous Solutions", J. Phys. Chem. B 2010, 114, 1939-1945.
Li, et al "Effects of Zeolite Membrane Structure on the Separation of 1,3-Propanediol From Glycerol and Glucose by Pervaporation"; Chem. Mater 2001, 13, 1865-1873.
Gil, et al Acidic Hydroxyl Groups in Zeolites X and Y: A Correlation Between Infrared and Solid-State NMR Spectra; J. Phys. Chem. 1994, 98, 930-933.
http://en.wikipedia.org/wiki/2-Methyltetrahydrofuran—accessed on Jun. 1, 2011—Wikipedia, the free encyclopedia; (downloaded attachment from the web Jan. 10, 2013).
Htun, et al Preparation of Zeolite (NaX,Faujasite) From Pure Silica and Alumina Sources; International Conference on Chemical Processess and Environmental issues (ICCEEI'2012) Jul. 15-16, 2012, Singapore, 212-216.

CONTINUOUS PRODUCTION OF BIODERIVED ESTERS VIA SUPERCRITICAL SOLVENT PROCESSING USING SOLID HETEROGENEOUS CATALYSTS

FIELD OF THE INVENTION

The present disclosure relates to the continuous production of ester based organic compounds from renewable natural products via supercritical solvent processing in the presence of solid heterogeneous catalysts. More specifically, nanostructured heterogeneous catalysts may be employed for the continuous transesterification of fatty acid triglycerides using nanostructured catalysts in the presence of supercritical alcohols to provide alkyl esters for a variety of industrial applications.

BACKGROUND

Biobased ester products typically consist of long-chain fatty acid alkyl (methyl, ethyl, propyl, or butyl) esters derived from triglycerides present in vegetable oil, animal fat, or plant lipids by transesterification type reactions. For example, biodiesel is an environmentally friendly fuel, non-toxic, and identified as biodegradable. Due to global climate changes and the decline in world crude oil production along with the rising prices of petroleum products, biodiesel has received considerable attention and may offer a promising alternate energy resource.

Currently, biodiesel is commercially produced from edible vegetable oils such as palm oil, corn oil, coconut oil, sunflower oil, and soybean oil. The fatty acid triglycerides of those oils are converted to the respective alkyl ester (the biodiesel) and glycerin by aqueous based acid-catalyzed or base-catalyzed transesterification in the presence of an excess amount of methanol or ethanol. Biodiesel can then be separated from glycerin and the glycerin by-product can be used to make soap. In addition, the alkyl ester products may be hydrogenated to provide various alcohols which may then serve to supply a variety of industrial end products.

Examples of acid catalysts that have been used for the transesterification reactions include sulfuric, sulfonic, phosphoric, and hydrochloric acid. The presence of water typically has a negative influence on the effectiveness of such acid catalysts, which water must be removed in order to maintain the catalytic efficiency. As a result; base catalysts are usually preferred compared to acid catalysts because of relatively higher conversion rates and relatively lower process temperatures compared to the acid-catalyzed transesterification process. Base catalysts include metal hydroxides, metal alkoxides, or alkaline-earth oxides.

As a consequence, current industrial transesterification procedures are performed in batch stirred tank reactors at temperatures ranging from 60 to 200° C. using homogeneous base catalysts in water solution. However, the use of homogeneous base catalysis typically requires neutralization and separation from the final reaction mixture and relatively high solvent consumption. Thus, the additional production costs of the bioderived ester are higher and not as competitive with the production costs of natural and petroleum-derived esters.

SUMMARY

The present disclosure relates to a continuous transesterification reaction method for trans-esterifying a triglyceride comprising continuously providing a triglyceride and continuously providing a monohydric alcohol. This may then be followed by continuously mixing the triglyceride and the monohydric alcohol in the presence of a nanostructured trans-esterification catalyst wherein said catalyst is present with a largest cross-sectional dimension of 50 nm to 200 nm and wherein the monohydric alcohol is present as a supercritical fluid. This is then followed by continuously trans-esterifying the triglyceride with the monohydric alcohol and generating mono-ester derivatives of the triglyceride.

In another exemplary embodiment, which falls within the general embodiment noted above, such that the features of both embodiments may be interchanged to provide a bio-derived ester, the present disclosure relates to a continuous trans-esterification reaction method for trans-esterifying a triglyceride comprising continuously providing a triglyceride and continuously providing methanol. This may then be followed by continuously mixing the triglycerides and the methanol in the presence of a nanostructured transesterification catalyst wherein the catalyst is present with a largest cross-sectional dimension of 50 nm to 200 nm and wherein the methanol is present as a supercritical fluid at a critical temperature of at least 240° C. and critical pressure of at least 1140 psig. This may then be followed by continuously trans-esterifying the triglyceride with the methanol and generating mono-ester derivatives of said triglyceride wherein the continuous trans-esterifying of the triglyceride with methanol is carried out in a reactor having a flow rate of 1.0 mL/min-10.0 mL/min and the residence time of the triglyceride in the reactor is 5.0 minutes to 15 minutes.

BRIEF DESCRIPTION OF THE DRAWINGS

The above-mentioned and other features of this disclosure, and the manner of attaining them, will become more apparent and better understood by reference to the following description of embodiments described herein taken in conjunction with the accompanying drawings, wherein.

DETAILED DESCRIPTION

As noted above, the present disclosure relates to the continuous production of ester based organic compounds from renewable natural products via supercritical solvent processing in the presence of solid heterogeneous catalysts. The renewable natural products that may be employed herein initially amount to any renewable resource that may offer a source of fatty acid triglycerides. Fatty acid triglycerides herein may be understood to include fats or oils comprising glycerine triesters of fatty acids. Preferably, the fatty acid triglycerides are in the form of vegetable oils but animal fats may also be employed. Vegetable oils may include lipid materials derived from plants which may include, e.g., camelina oil, jatropha curcas oil, salicornia oil, palm oil, soybean oil, rapeseed oil, sunflower seed oil, peanut oil, cottonseed oil, palm kernel oil, coconut oil and olive oil. Other renewable natural products that may provide a source for the continuous production of the indicated ester compounds may include linseed oil, corn oil, canola oil, soybean oil, tall oil, tall oil fatty acids, white grease, poultry fat, white tallow, yellow grease, crude tall oil, poultry fat (stabilized), and brown grease.

Fatty acids may be understood herein as acyclic aliphatic carboxylic acids containing from 4 to 28 carbon atoms, typically from 12 to 24 carbon atoms. Examples would therefore include lauric acid, myristic acid, palmitic acid, stearic acid, arachidic acid, behenic acid, lignoceric acid and cerotic acid. The fatty acids may therefore be saturated, monounsaturated or polyunsaturated (typically 2 or 3 carbon-carbon double bonds). Unsaturated fatty acids may therefore include elaidic acid, linoelaidic acid, myristoleic acid, palmitoleic acid, sapienic acid, oleic acid, linoleic acid, α-linolenic acid, arachidonic acid, eicosapentaenoic acid, erucic acid, docosahexaenoic acid. Natural fats may also contain relatively small amounts of other esterified or free fatty acids as well as relatively small amounts (1-4% wt.) of phospholipids, e.g. lecithin and relatively small amounts of other compounds.

Figure 1:
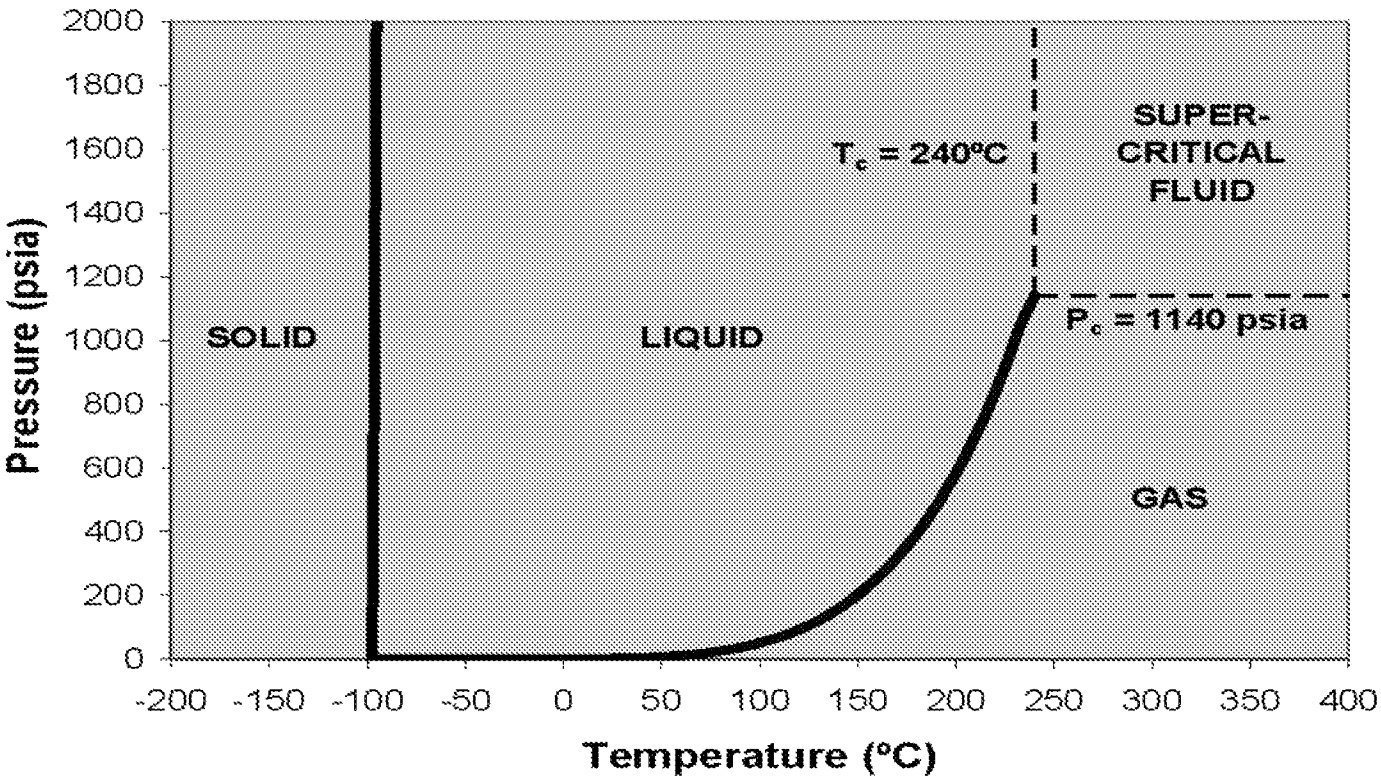
FIG. 1 is a phase diagram of methanol (pressure versus temperature) illustrating the region for the formation of methanol as a supercritical fluid.

The transesterification reaction of the fatty acid triglyceride preferably employs a monohydric alcohol which alcohol is present as supercritical fluid. Preferably, the monohydric alcohol comprises at least one alcohol selected from the group consisting of methanol, ethanol, n-propyl alcohol, n-butyl alcohol, n-pentyl alcohol. The use of the alcohol as a supercritical fluid is reference to the feature that the alcohol is present during the transesterification reaction herein under conditions where it is above its critical temperature and pressure. Preferably, the alcohol is methanol, and FIG. 1 illustrates the phase diagram for methanol. As can be seen, methanol indicates a critical temperature (Tc) of 240° C. and a critical pressure (Pc) of 1140 psi. At or above these temperatures and pressure the methanol will be in a form where distinct liquid and gas phases do not exist and it will demonstrate gas-like diffusivity and liquid-like viscosity. Accordingly, supercritical methanol may be present at temperatures of 240° C. to 350° C. and at pressures of 1200 psig to 3500 psig. In such regard, in the case of ethanol, Tc=240.9° C. and Pc=891 psi.

In the context of the use of supercritical alcohol herein, it is noted that the triglycerides within a given vegetable oil may form a single phase oil/supercritical-alcohol mixture. As to be discussed more fully herein, the conversion rate of the triglycerides to esters is observed to significantly increase in the supercritical alcohol medium. Furthermore, the conversion herein is one that that is not adversely affected by the presence of water and free fatty acids. In addition, the process herein is one which may eliminate any need for a purification step of the oils prior to the transesterification reaction in the supercritical fluid media.

The supercritical transesterification herein preferably employs heterogeneous type catalysts. A heterogeneous catalyst may be understood as a catalyst that does not dissolve in the transesterification media. Such heterogeneous catalysts have been observed to offer several advantages for bioderived ester production due to their reusability, relatively easier product separation, and relatively improved product purity as water washes may now be eliminated. In addition, it has also been found preferable that the heterogeneous catalyst is present in nano-structured form, which is reference to the feature that the catalyst has as its largest cross-sectional dimension a size of 50 nm to 200 nm, including all increments therein, in 1 nm size range. Accordingly, the nano-structured catalyst herein may be present with a largest cross-sectional diameter of 50 nm, 51 nm, 52 nm, up to 200 nm. More preferably, the nano-structured catalysts herein are those which may have a largest cross-sectional size of 50 nm to 100 nm.

Preferably, the nano-structured catalysts to promote transesterification of the triglyceride may be selected from the following sources: (1) zeolite, (2) hydrotalcite, and (3) titanosilicate. In addition, other nano-structured catalysts as described herein may be utilized.

With respect to zeolite, it may be generally understood as an aluminosilicate based mineral. Typically, zeolites have a unit consisting of a tetrahedral complex of $Si^{4+}$ and $Al^{3+}$ in coordination with four oxygen atoms. The tetrahedral units of $(SiO_4)$ and $(AlO_4)^-$ may be linked to each other by shared oxygen atoms to form three-dimensional networks. The networks produce channels and cavities of molecular dimensions. Charged compensating cations are found inside the channels and cavities of the zeolitic materials. The various possible linkages between the primary tetrahedral structure determine the different zeolite structures, which can have different surface areas, pore size, and/or pore shape. Besides silicon and aluminum, other atoms can be incorporated into lattice positions.

In general suitable zeolites will be of the faujasite structure with a $SiO_2/Al_2O_3$ mole ratio in the range of about 2 to 8. With regard to structural classification, those zeolites with a double 6-ring or faujasite structure are generally suitable for use herein. Such zeolites characteristically have pore diameters in excess of 6 angstroms, which is appropriate for admission of methanol. Type X has a typical oxide formula $Na_2O.Al_2O_3.2.5SiO_2.6H_2O$ with $SiO_2/Al_2O_3$ in the range of 2.0-3.0. Type Y has a typical oxide formula $Na_2O.Al_2O_3.4.8SiO_2.8.9H_2O$ with $SiO_2/Al_2O_3$ ranging from 3.0-6.0.

A particularly preferred zeolite includes faujasite (zeolite-Y) which is a hydrated sodium and calcium aluminosilicate mineral. An empirical formula for faujasite-Na is $3.5(Ca_{0.3})3.5(Na_{0.6})3.5(Mg_{0.1})Al_7Si_{17}O_{48}.32(H_2O)$. The faujasite-Na may also preferably include potassium and/or cesium to increase its catalytic activity. The faujasite-Na may also undergo hydrothermal treatment, extraction by acid complexation or treatment with citric acid in an unbuffered media. Such is observed to optimize the acidity and nanopore distribution.

Anionic clays may also be employed as the nano-structured transesterification catalyst one of which is a hydrotalcite. A hydrotalcite may be understood as a layered double hydroxide with positively charged layers and charge balancing anions in the interlayer region. They may have the general formula $[M^{z+}_{1-x}M^{3+}_{x}(OH)_2]^{q+}(X^{n-})_{q/n}.yH_2O$. Typically, $M^{2+}$ is $Ca^{2+}$, $Mg^{2+}$, $Mn^{2+}$, $Fe^{2+}$, $Co^{2+}$, $Ni^{2+}$, $Cu^{2+}$ or $Zn^{2+}$ and q=x and y=2-4. The hydrotalcites herein may be modified in its activity towards transesterification by the introduction of potassium or cesium.

One preferred hydrotalcite is a magnesium-aluminum hydrotalcite having the general formula:

$$[Mg_{(1-x)}Al_x(OH)_2]^{x+}(CO_3)_{x/n}{}^{2-}$$

where x may have a value of 0.25-0.55 and n has a value of 2.0. One may also increase the Mg content in order to increase the transesterification activity herein.

One may also employ, as the nano-structured catalyst, a porous titanosilicate which may be generally understood as a titanosilicate (ETS-10) with a three-dimensional 12 ring channel system containing micropores. ETS-10 has also been characterized to reveal a chemical formula of $(Na_{1.5}K_{0.5})TiSi_5O_{13}.xH$ having a mixture of two polymorphs with tetragonal and monoclinic symmetry. The ETS-10 herein may also be enhanced in its catalytic activity through the use of potassium and cesium.

In addition, the nano-structured catalyst herein may be selected from: (1) metal carbonates that are supported on aluminum, such as sodium carbonate, magnesium carbonate, potassium carbonate or calcium carbonate; (2) metal hydroxides that are supported on aluminum, such as sodium hydroxide, magnesium hydroxide, potassium hydroxide or calcium hydroxide; (3) zirconium oxysulfate ($ZrOSO_4$); (4) lanthanum oxide ($La_2O_3$); (5) magnesium oxide (MgO); (6) mixtures of $La_2O_3$ and MgO.

Figure 2:
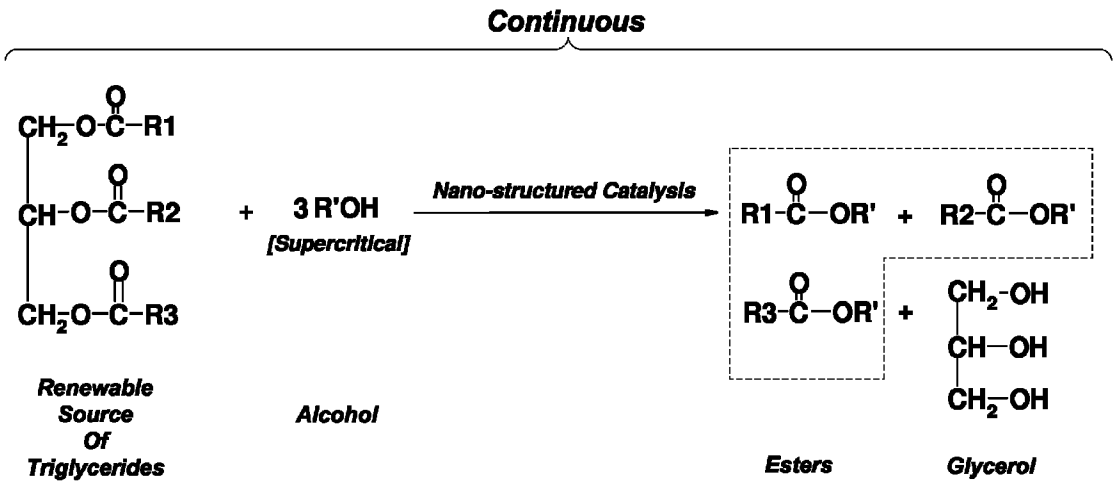
FIG. 2 is a general reaction scheme for the continuous production of ester based organic compounds by trans-esterification of triglycerides utilizing supercritical monohydric alcohols in the presence of a nanostructured catalyst.

The transesterification using nano-structured catalysts in a supercritical alcohol medium is preferably made continuous. This may be understood as reference to the ability to continuously provide the source of the triglyceride, continuously provide a monohydric alcohol in the supercritical state, continuously mix the triglyceride and the monohydric alcohol in the supercritical state in a reactor which continuously provides a nano-structured catalyst, and continuously producing the fatty acid mono-ester derivative product. It may therefore now be appreciated that the general scheme herein may be summarized as now shown in FIG. 2. It is noted that R1-CO—O—, R2CO—O— and R3-CO—O—, as previously alluded to above, may contain 4-28 carbon atoms in the illustrated triglyceride structure. The supercritical monohydric alcohol, R'OH is such that R' may be —$CH_3$, —$CH_2CH_3$, —$CH_2CH_2CH_3$, —$(CH_2)_3$—$CH_3$ and/or —$(CH_2)_4$—$CH_3$.

The continuous transesterification herein may be preferably achieved by the use of fixed-bed tubular type reactors. A continuous flow reactor may be understood as a reactor that may be used in a continuous flow mode with reagents flowing in and products being removed. A single phase flow in the tubular reactor may be configured to run upward or downward. Two-phase flow may be configured wherein one may have co-current up-flow, counter-current (liquid down, gas up) or co-current down flow. The tubular reactor used herein may be of single wall design and be heated with an external furnace or they can be jacketed for heating and cooling with a circulating heat transfer medium. The tubular reactor herein may be packed and therefore contain a fixed bed with the aforementioned nano-structured catalyst for the heterogeneous transesterification. Flow rates through the tubular reactor may preferably be in the range of 1.0 mL/min.-10.0 mL/min. Preferably, the flow rate may be 3.0 mL/min to 6.0 mL/min. Residence time of the triglyceride in the reactor may preferably be in the range of 5 minutes to 15 minutes. More preferably, residence time in the reactor may be in the range of 8 minutes to 12 minutes.

Preferably, the fixed-bed tubular reactor herein may be constructed from a ⅜ inch inner diameter with a wall thickness of 0.049 inches. The reactor may have two thermocouples inserted through the side wall of the tube about one-third of the way from each end to monitor the temperatures of the reagents contacting the catalyst. The thermocouples may be inserted through thermowells welded to each side of the reactor tube. The pressure within the reactor may be controlled with a pressure controller and detected with a pressure transducer. A pressure gage may also be installed on-line to ensure that supercritical monohydric alcohols (e.g. supercritical methanol) are maintained.

The stainless steel reactor may be installed in an aluminum furnace enclosure insulated with calcium silicate material. The inlet of the reactor may be equipped with an on-line pressure gage to monitor a high pressure Eldex metering pump. Pressure safety valves may be installed on the inlet of the reactor and set at about 4,000 psig. A pressure exceeding the control limit would then open the safety value and release excess pressure in the reactor to a safe location.

EXAMPLE 1

A feedstock was prepared combining methanol and waste cooking oil are a molar ratio of 40:1. Prior to mixing, the waste cooking oil was filtered through a 0.7 micron filter to remove impurities that might potentially plug the continuous reactor system. The solution was biphasic was constantly mixed to maintain consistency in the feedstock being pumped to the reactor system.

A 4 foot long tubular reactor was made of a ⅜" outer diameter stainless steel tubing. The total volume of the reactor is 47.41 mL and it was packed with 18.8 g of solid catalyst. Zeolite-X, zeolite-Y, zeolite treated with sulfuric acid, ETS-10, and hydrotalcite were all evaluated as the nano-structured catalysts.

Methanol was transferred to the catalyst-packed reactor, heated, and pressurized to maintain at an initial supercritical condition (≧240° C. and ≧1140 psia). The waste cooking oil and methanol mixture was then pumped into the packed reactor at a rate of 3.0 mL/minute and controlled at supercritical condition. The biphasic liquid product obtained from the triglycerides transesterification reaction was clear yellow methyl esters (biodiesel) with glycerin settled to the bottom of the liquid. Gas chromatography interfaced with a mass spectrometer (GC-MS) analytical method detected the biodiesel compounds such as palmitic acid methyl ester, palmitoleic acid methyl ester, steric acid methyl ester, oleic acid methyl ester, linoleic acid methyl ester, elaidic acid methyl ester, linoelaidic acid methyl ester, and linolenic acid methyl ester. Total triglycerides were analyzed by high performance liquid chromatography (HPLC) analytical method which confirmed that 99.5% of the waste cooking oil was converted to biodiesel in supercritical methanol catalyzed with hydrotalcite.

EXAMPLE 2

A 4' long stainless steel tubular reactor was packed with 18.8 g of NaX zeolite catalyst. Methanol was pumped to the catalyst-packed reactor and maintained at the supercritical condition (≧240° C. and ≧1140 psia). The mixture of waste cooking oil and methanol at a molar ratio of 1:40 was then pumped into the packed reactor at a rate of 3.0 mL/minute and controlled at supercritical conditions. The product collected downstream contained 99.5% of the methyl eaters converted from waste cooking oil.

As should now be apparent, the continuous production of bio-derived esters may now be achieved from renewable resources such as plant, animal fats, and waste cooking oil, all of which provide a feedstock of triglycerides. Unlike conventional methods to form ester based derivatives (biodiesel), the present disclosure also provides a continuous process wherein, as noted, the presence of water and free fatty acids will have no effect. In addition, the continuous production herein provides relatively highly efficient yields of ester based derivatives that are regularly at or above 98.0%, and more specifically, in the range of 98.0% to 99.9%. In addition, the present disclosure also provides a source of glycerine that now may be obtained at relatively lower temperatures (240° C. to 350° C.) and pressures (1200 psig to 3500 psig) such that the glycerine will not be prone to degrade to other alcoholic based by-products.

The foregoing description of several methods and embodiments has been presented for purposes of illustration. It is not intended to be exhaustive or to limit the claims to the precise steps and/or forms disclosed and modifications and variations are possible in light of the above teaching. It is intended that the scope of the invention be defined by the claims appended hereto.

The invention claimed is:

1. A continuous trans-esterification reaction method for trans-esterifying a triglyceride comprising:

continuously providing triglycerides;

continuously providing a monohydric alcohol;

continuously mixing the triglycerides and the monohydric alcohol in the presence of a nanostructured transesterification catalyst wherein said catalyst is present with a largest cross-sectional dimension of 50 nm to 200 nm and wherein said monohydric alcohol is present as a supercritical fluid;

continuously trans-esterifying said triglycerides with said monohydric alcohol and generating mono-ester derivatives of said triglycerides.

2. The method of claim 1 wherein said triglycerides comprise a fatty acid triglyceride.

3. The method of claim 2 wherein said fatty acid triglycerides have the structure:

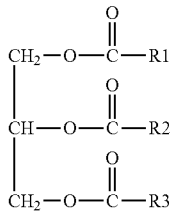

wherein R1, R2 or R3 comprise an acyclic aliphatic hydrocarbon group.

4. The method of claim 3 wherein said acyclic hydrocarbon group comprises a saturated hydrocarbon group, a monounsaturated hydrocarbon group, and/or a polyunsaturated hydrocarbon group.

5. The method of claim 1 wherein said monohydric alcohol is selected from the group consisting of methanol, ethanol, n-propyl alcohol, n-butyl alcohol or n-pentyl alcohol.

6. The method of claim 1 wherein said monohydric alcohol comprises methanol and said methanol is present at a critical temperature (Tc) of at least 240° C. and a critical pressure (Pc) of at least 1140 psi.

7. The method of claim 1 wherein said monohydric alcohol is present at a critical temperature (Tc) of 240° C. to 350° C. and critical pressure (Pc) of 1200 psig to 3500 psig.

8. The method of claim 1 wherein said nano-structured catalyst is present with a largest cross-sectional dimension of 50 nm to 100 nm.

9. The method of claim 1 wherein said triglyceride is provided from one or more of the following: camelina oil, jatropha curcas oil, salicornia oil, palm oil, soybean oil, rapeseed oil, sunflower seed oil, peanut oil, cottonseed oil, palm kernel oil, coconut oil, olive oil, linseed oil, corn oil, canola oil, soybean oil, tall oil, tall oil fatty acids, white grease, poultry fat, white tallow, yellow grease, crude tall oil, and brown grease.

10. The method of claim 1 wherein said nano-structured catalyst comprises a zeolite mineral.

11. The method of claim 1 wherein said nano-structured catalyst comprises zeolite-X of the formula $Na_2O.Al_2O_3.2.5SiO_2.6H_2O$ where $SiO_2/Al_2O_3$ is in the range of 2.0-3.0.

12. The method of claim 1 wherein said nano-structured catalyst comprises zeolite-Y of the formula $Na_2O.Al_2O_3.4.8SiO_2.8.9H_2O$ wherein $SiO_2/Al_2O_3$ ranges from 3.0-6.0.

13. The method of claim 1 wherein said nano-structure catalyst comprises faujasite-Na of the formula $3.5(Ca_{0.3})3.5(Na_{0.6})3.5(Mg_{0.1})Al_7Si_{17}O_{48}.32(H_2O)$.

14. The method of claim 1 wherein said nano-structured catalyst comprises a hydrotalcite of the general formula $[M^{z+}_{1-x}M^{3+}_x(OH)_2]^{q+}(X^{n-})_{q/n}.yH_2O$ wherein $M^{2+}$ is one of $Ca^{2+}$, $Mg^{2+}$, $Mn^{2+}$, $Fe^{2+}$, $Co^{2+}$, $Ni^{2+}$, $Cu^{2+}$ or $Zn^{2+}$ and q=x and y=2-4.

15. The method of claim 1 wherein said nanostructured catalyst comprises magnesium-aluminum hydrotalcite of the general formula $[Mg_{(1-x)}Al_x(OH)_2]^{x+}(CO_3)_{x/n}{}^{2-}$ where x has a value of 0.25-0.55 and n has a value of 2.0.

16. The method of claim 1 wherein said nano-structured catalyst comprises titanosilicate ETS-10.

17. The method of claim 1 wherein said nano-structured catalyst comprises one of sodium carbonate, magnesium carbonate, potassium carbonate or calcium carbonate supported on aluminum.

18. The method of claim 1 wherein said nano-structured catalyst comprises one of sodium hydroxide, magnesium hydroxide, potassium hydroxide or calcium hydroxide supported on aluminum.

19. The method of claim 1 wherein said nano-structured catalyst comprises zirconium oxysulfate ($ZrOSO_4$).

20. The method of claim 1 wherein said nano-structured catalyst comprises lanthanum oxide ($La_2O_3$).

21. The method of claim 1 wherein said nano-structured catalyst comprises magnesium oxide (MgO).

22. The method of claim 1 wherein said nano-structured catalyst comprises a mixture of $La_2O_3$ and MgO.

23. A continuous trans-esterification reaction method for trans-esterifying a triglyceride comprising:

continuously providing a triglyceride;

continuously providing methanol;

continuously mixing the triglycerides and the methanol in the presence of a nano-structured transesterification catalyst wherein said catalyst is present with a largest cross-sectional dimension of 50 nm to 200 nm and wherein said methanol is present as a supercritical fluid at a critical temperature of at least 240° C. and critical pressure of at least 1140 psig;

continuously trans-esterifying said triglyceride with said methanol and generating mono-ester derivatives of said triglyceride wherein said continuous trans-esterification of methanol is carried out in a reactor having a flow rate of 1.0 mL/min-10 mL/min and the residence time of the triglyceride in the reactor is 5.0 minutes to 15 minutes.

* * * * *